US009022389B1

(12) United States Patent
Berg

(10) Patent No.: US 9,022,389 B1
(45) Date of Patent: May 5, 2015

(54) GROOVED SUPPORTING MEMBER FOR ASSISTING IN THE CONSTRUCTION OF A CARD STRUCTURE

(76) Inventor: Bryan N. Berg, Lamy, NM (US)

( * ) Notice: Subject to any disclaimer, the term of this patent is extended or adjusted under 35 U.S.C. 154(b) by 69 days.

(21) Appl. No.: 13/584,312

(22) Filed: Aug. 13, 2012

Related U.S. Application Data

(60) Provisional application No. 61/523,072, filed on Aug. 12, 2011.

(51) Int. Cl.

| | |
|---|---|
| ***A63F 1/10*** | (2006.01) |
| ***A63F 11/00*** | (2006.01) |
| *A63H 33/10* | (2006.01) |
| *A63F 9/26* | (2006.01) |
| *A63F 3/00* | (2006.01) |

(52) U.S. Cl.
CPC ..... *A63F 11/00* (2013.01); *A63H 33/10* (2013.01); *A63F 1/10* (2013.01); *A63F 9/26* (2013.01); *A63F 3/00634* (2013.01); *A63F 2003/00599* (2013.01)

(58) Field of Classification Search
CPC ..... A63F 2003/00744; A63F 1/10; A63F 2003/00599; A63F 3/00634; A63F 9/26; A63H 33/10
USPC ..... 273/148 A, 150; 446/111, 112, 113, 105
See application file for complete search history.

(56) References Cited

U.S. PATENT DOCUMENTS

| | | | | |
|---|---|---|---|---|
| 2,522,149 | A * | 9/1950 | Tunstall | 434/79 |
| 4,925,143 | A * | 5/1990 | Sandmeyer | 248/441.1 |
| 6,015,149 | A * | 1/2000 | Burk | 273/148 A |
| 7,371,146 | B2 | 5/2008 | Scarborough | |
| 2002/0090881 | A1 * | 7/2002 | Turnham | 446/85 |
| 2005/0073094 | A1 * | 4/2005 | Antos | 273/148 A |
| 2008/0252005 | A1 * | 10/2008 | Pincus | 273/150 |
| 2012/0000059 | A1 * | 1/2012 | Fox et al. | 29/525.01 |

FOREIGN PATENT DOCUMENTS

| | | | |
|---|---|---|---|
| GB | 2031289 | A * | 4/1980 |

* cited by examiner

*Primary Examiner* — Benjamin Layno
(74) *Attorney, Agent, or Firm* — Brick Gentry PC; Brian J. Laurenzo; Jessica L. Susie

(57) ABSTRACT

A grooved supporting member for assisting in the construction of a card structure is provided. Specifically, the grooved supporting member provides support for the beginning foundational planar stackable members. The grooved supporting member includes a planar base member, top surface, bottom surface, at least one edge, and at least one groove. Preferably, the groove is cut completely through the planar base member and provides lateral support for a planar stackable member. In the preferred embodiment, the grooved supporting member has four edges and four grooves, thus providing support for four planar stackable members to create the cell of a card structure. The user may employ one or more of the grooved supporting members of the present invention in a card structure. Further disclosed is a kit including a grooved supporting member of the present invention and a plurality of stackable planar members.

16 Claims, 3 Drawing Sheets

GROOVED SUPPORTING MEMBER FOR ASSISTING IN THE CONSTRUCTION OF A CARD STRUCTURE

CROSS-REFERENCE TO RELATED APPLICATIONS

This application claims priority from U.S. Provisional Application Ser. No. 61/523,072, filed Aug. 12, 2011, entitled AN APPARATUS FOR ASSISTING IN THE CONSTRUCTION OF A CARD STRUCTURE, the contents of which is hereby incorporated in its entirety by reference.

FIELD OF THE INVENTION

The present invention relates to toys and games. More particularly, the present invention relates to a grooved supporting member for assisting in the construction of a card or card-like structure by holding the initial elements in position to establish a strong foundation for the card structure.

BACKGROUND

A card structure, such as a house of cards or card tower, is made using planar stackable members such as playing cards, business cards, index cards, recipe cards or the like. These card structures are built using a method that relies on nothing more than balance and friction in order to stay upright. Ideally, adhesives or other external connecting methods are not used, and no damage or alterations are made to the planar stackable members themselves. The larger the card structure, the more likely it is to fall due to the higher number of balanced planar stackable members that could fail and compromise the integrity of the card structure. Important to the structural integrity of the card structure are the first few cards, known in the art as the "cell" or "pipe column", which provides the foundation for the structure. Beginners have traditionally experienced difficulties in balancing the first few planar stackable members to build the cell of the structure. Accordingly, there is a need in the art for a grooved supporting member that will assist a person in the construction of a card structure by providing support for the cell of the structure.

SUMMARY OF THE INVENTION

The grooved supporting member of the present invention is intended to assist in the construction of a card or card-like structure, including but not limited to a house of cards or card tower, by providing support for the cell of the structure. The invention is particularly applicable for those who are learning to build card structures, although those skilled at building card structures will also find the grooved supporting member useful. In the preferred embodiment, the grooved supporting member provides lateral support for the first four planar stackable members of a card building structure. To this end, the grooved supporting member includes grooves into which the planar stackable members are inserted. The walls of the grooves support the planar stackable members laterally. Preferably the grooves are cut all the way through the thickness of the grooved supporting member, such that the gravitational weight of the planar stackable members is supported by the surface below the grooved supporting member, such as a floor or table. Preferably, the grooved supporting member may hold planar stackable members in both a vertical and horizontal manner.

In the preferred embodiment, the grooved supporting member of the present invention comprises a planar base member having a top surface, a bottom surface, at least one edge, and at least one recessed groove for receiving a building card structural member. Further, the grooved supporting member is small and thin enough that it will not interfere with planar stackable members beyond the cell. Preferably the grooved supporting member is light in weight and is colored such that it will go largely unnoticed within other elements of the card structure. The user may use one or more grooved supporting members of the present invention when building a card structure in one or more stories of the structure.

DETAILED DESCRIPTION

The following is a detailed description of an embodiment of a grooved supporting member 100 for assisting in the construction of a card or card-like structure, including but not limited to a house of cards or card tower, of the present invention. For ease of discussion and understanding, the following detailed description and illustrations often refer to the grooved supporting member 100 for use with playing cards. However, it should be appreciated that the grooved supporting member 100 can be used with any type of planar stackable member 112 including but not limited to playing cards, business cards, and recipe cards. Furthermore, it should be understood that the grooved supporting member 100 is not limited to use with cards as they are generally known. The scope of the present invention includes building components of any size and shape that could be used to create structures in the same manner as playing cards are used to build a card structure, including but not limited to planar stackable members made of wood, plastic, and metal.

The grooved supporting member 100 provides the function of holding the foundational planar stackable members 112 of a horizontal or vertical card structure in position. Often, the grooved supporting member 100 of the present invention is used to establish a strong foundation for the card structure to be built. The grooved supporting member 100 of the present invention further provides the function of teaching new builders to construct a proper cell or foundation. In the preferred embodiment, this means that the grooved supporting member 100 holds the first four planar stackable members 112 of a building card structure, sometimes called a "cell" or "pipe column" of a building structure. However, one of skill in the art will understand that other embodiments of the grooved supporting member 100 may be designed to hold more or fewer planar stackable members 112 as the application may require. Furthermore, the grooved supporting member 100 of the present invention need not only be used for the foundation of a structure to be built. Rather, the grooved supporting member 100 may be used anywhere in the structure. For example, the planar stackable members 112 supported by the grooved supporting member 100 may be used as a foundation for other planar stackable members 112 anywhere in the structure or it may be used to hold planar stackable members 112 is a decorative capacity. Moreover, more than one grooved supporting member 100 may be used in a structure.

Figure 1:
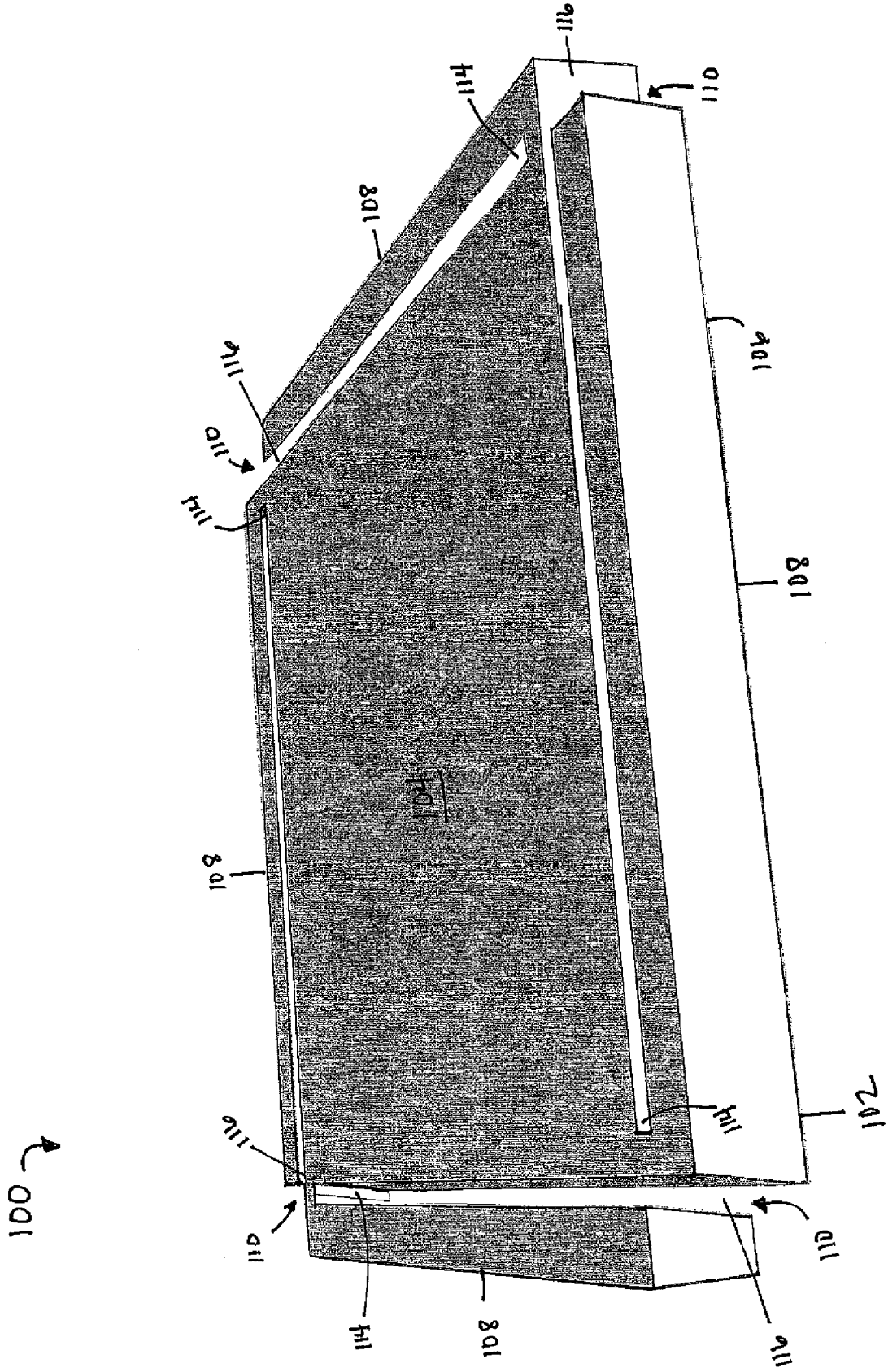
FIG. 1 is a perspective view according to an embodiment of a grooved supporting member for assisting in the construction of a card structure of the present invention.

Referring to FIG. 1, a block or grooved supporting member 100 of the present invention comprises a planar base member 102. The planar base member 102 comprises a top surface 104, bottom surface 106, at least one edge 108, and at least one groove 110. Preferably, the groove 110 is located near to the edge 108 of the planar base member 102. In the preferred embodiment, the planar base member 102 comprises four edges 108 and four grooves 110. However, the planar base member 102 may comprise any number of edges 108 and grooves 110 that the application requires. The bottom surface 106 should be generally flat so as to allow the grooved supporting member 100 to be placed securely on the surface below. The top surface 104 is also generally flat so as to not interfere with the planar stackable members 112, but may be any shape that allows for a card structure to be built. In addition, a flat shape on both the top surface 104 and bottom surface 106 allows multiple grooved supporting members 100 to be stacked on top of each other for shipping and packaging.

Preferably the grooved supporting member 100 of the present invention is made of injection molded plastic. However, one skilled in the art will understand that any suitable material may be used, including but not limited to paper, metal, or wood. The material should be strong enough to prevent the edges 108 from easily breaking off of the grooved supporting member 100. The grooved supporting member 100 should be as thin and light as possible. Although the grooved supporting member 100 may be any color, preferably the color should allow the grooved supporting member 100 to go largely unnoticed within the other elements of the card structure. The grooved supporting member 100 of the present invention should be small enough to avoid interfering with the placement of the additional planar stackable members 112 beyond the initial foundational planar stackable members 112.

Figure 2:
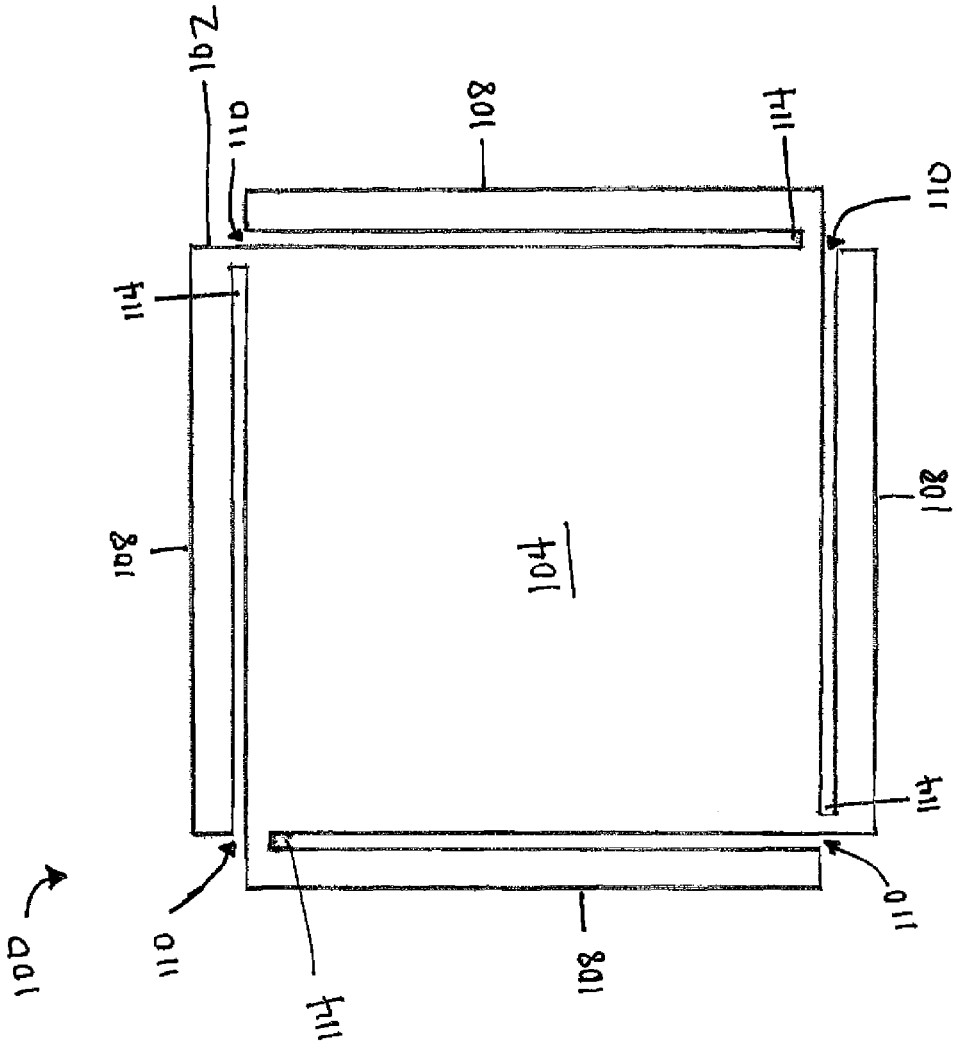
FIG. 2 is a top plan view according to the embodiment of a grooved supporting member for assisting in the construction of a card structure of FIG. 1.

As can be seen in FIGS. 1 and 2 in the preferred embodiment, the grooved supporting member 100 of the present invention is generally a square-shaped block having four edges 108 and four grooves 110. However, the grooved supporting member 100 may be any shape and have any number of edges 108 and grooves 110 as the application may require. Preferably, the grooves 110 extend all the way from the top surface 104 through the bottom surface, thus allowing each card to sit directly on the surface below the grooved supporting member 100. Accordingly, in the preferred embodiment, the grooved supporting member 100 supports the planar stackable members 112 in a lateral fashion, rather than supporting their gravitational weight. However, one of skill in the art will recognize that the grooves 110 may take on many embodiments without departing from the scope of the invention. For example, the groove need not extend all the way through the planar base member 102.

In the preferred embodiment, each groove 110 has an attachment end 114 and an open end 116. The attachment end 114 provides a connection between the edge 108 of the grooved supporting member 100 and the remainder of the planar base member 102 located on the opposite side of the groove 110 from the edge 108. The open end 116 is completely open. Therefore, the edge 108 resembles an arm that protrudes from the planar base member 102 and angles such that it is parallel to the planar base member 102. The user can slide a planar stackable member 112 into the groove 110 through the open end 116. The planar stackable member 112 will be laterally supported by the edge 108 and the remainder of the planar base member 102. In the preferred embodiment, the open end 116 of each groove 110 stops short of the adjacent edge 108 of the generally square-shaped grooved supporting member 100. This enables the user to expand the first four planar stackable members 112 into a grid that originated with the cell and includes additional identical cells. This shape prevents the edge 108 or arm from being in the way of additional planar stackable members 112. Moreover, the attachment end 114 provides a stop for the planar stackable member 112 and holds it in place with the other planar stackable members 112. However one of skill in the art will recognize that the grooves 110 need not be open at one end. Rather, the grooves 110 may be closed at both ends while still allowing a planar stackable member 112 to be supported therein.

The dimensions of the entire grooved supporting member 100 are preferably in the range of approximately 2.2 inches by 2.2 inches to 2.625 inches by 2.625 inches. The thickness of the grooved supporting member 100 should be from 0.125 (1/8) inch to 0.1875 (3/16) inch. These measurements accommodate Bridge size playing cards or planar stackable members 112, which are approximately 2.25 inches×3.5 inches, but the grooved supporting member 100 may be used with many sizes of playing cards. Moreover, the dimensions of the grooved supporting member 100 may be modified to accommodate planar stackable members 112 of any size. For example, one could build a grooved supporting member 100 for use with planar stackable members 112 that are many feet in length without departing from the scope of the invention. Preferably the grooved supporting member 100 and planar stackable members 112 conform to a specific ratio, which will be discussed in further detail below. However, one of skill in the art will recognize that many uses of the grooved supporting member 100 will be playing cards generally known in the art.

Although the grooves 110 may be at any angle without departing from the scope of the invention, as seen in FIG. 1, preferably the grooves 110 are at an angle to the normal of the planar base member 102. Specifically, the grooves 110 slant inwardly toward the center of the grooved supporting member 100 to encourage the planar stackable members 112 to lean inwardly towards each other. However, the angle should still allow the planar stackable members 112 to be used vertically. In the preferred embodiment, the grooves 110 angle inwardly toward the center of the grooved supporting member 100 at an angle of approximately 9.2 degrees from normal. Said another way, the angle of the groove 110 is approximately 80.8 degrees from horizontal. Preferably, the angle still allows the card structure to collapse when activated to do so. The grooves 110 may also be different angles when different shaped structures are to be obtained. For example, the grooved supporting member 100 of the present invention could be used to assemble planar stackable members 112 in a dome, fan, or any other configuration. In these exemplary embodiments, the grooves 110 may be angled differently. Moreover, the grooves 110 of the grooved supporting members 100 need not be identical. The grooves 110 may vary in any measurement, including angle.

Although the grooves 110 may be any width suitable for the purpose of the grooved supporting member 100, in the preferred embodiment the grooves 110 are approximately 0.0625 inches in width. This dimension generally accommodates planar stackable members 112 that when stacked fifty-four (54) to a deck measure from 15/32 inch in thickness to 5/8 inch in thickness, which results in a thickness of 0.00868 to 0.011574 inch per building card structural member 112.

Figure 3:
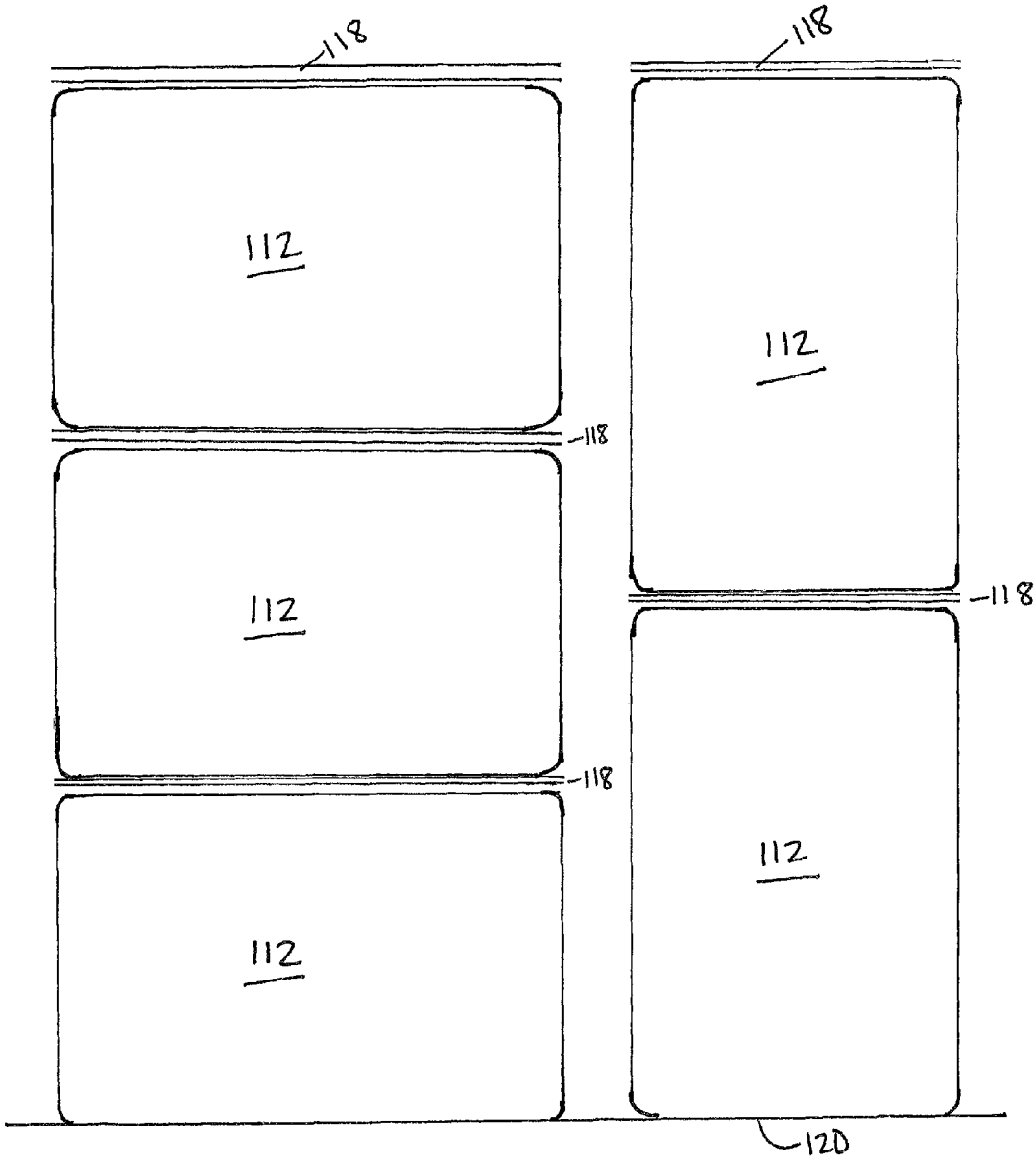
FIG. 3 is a side elevational view of planar stackable members for use with an embodiment of a grooved supporting member for assisting in the construction of a card structure of the present invention.

As mentioned above, the preferred planar stackable members 112 used with the grooved supporting member 100 have a specific ratio. Specifically, as shown in FIG. 3 two vertical stories built with two mortar joints 118 equals three vertical stories built with three mortar joints 118. The term "mortar joints" 118 refers to a three-card thick layer of planar stackable members placed flat, not overlapping, as a rooftop between each layer. Preferably the length of the grooves 110 are just less than half the length of the planar stackable member 112, which will be just less than the width of the planar stackable member 112. This ratio allows the planar stackable members 112 to be used both horizontally and vertically in the grooved supporting member 100. It further allows the user to use planar stackable members 112 in both a horizontal manner and a vertical manner on the building surface 120 or on other planar stackable members 112 in the same structure. Mortar joints 118 can have many functions including but not limited to supporting further planar stackable members 112, supporting further grooved supporting members 100 or as a rooftop. The planar stackable members 112 may include rounded corners, as illustrated in FIG. 3, or they may include non-rounded corners. Furthermore, if the corners of the planar stackable members 112 are rounded, the radii of the corners may be any value. The specifications for the planar stackable members 112 may vary if two of the planar stackable members 112 are hinged together on the shortest side. For example, the hinged planar stackable member could be manufactured of heavier paper weight than a single planar stackable member, with the hinge manufactured to favor a 25-30 degree angle when used vertically and a 90 degree angle when used horizontally Preferably the planar stackable members 112 are not affected by moisture levels of the environment in which they are located. Also, preferably the planar stackable members 112 will have their strongest axis as the long axis, thus providing the strength necessary to build structures from vertically placed planar stackable members 112. Furthermore, the planar stackable members 112 used with the grooved supporting member 100 will have a very slight amount of camber or paper memory in two directions, namely, when the numbers of the planar stackable members 112 are placed down, the planar stackable member 112 would arch slightly upwardly in the center. However, this slight paper memory may be so slight as to be invisible.

The present invention further includes a kit for building a structure from planar stackable members 112. The kit includes a support member for supporting at least one planar stackable member 112. Generally the support member includes grooves 110 for supporting the planar stackable member 112, however other means may be used without departing from the scope of the present invention. The kit further includes a plurality of planar stackable members 112. In many embodiments the planar stackable members 112 of the kit of the present invention will be playing cards, and the plurality will be one or more decks of playing cards. Although one of skill in the art will recognize that any planar stackable members 112 may be used, the planar stackable members 112 contained in the kit of the present invention are used to make structures wherein the planar stackable members 112 are held in place in the structure by balance and friction. In addition, at least one support member of the present invention may be used to hold said planar stackable members 112 in place. The support member and planar stackable members 112 of the present invention are reusable. Accordingly, structures built with the kit may be collapsed and used to build further structures.

Although various representative embodiments of this invention have been described above with a certain degree of particularity, those skilled in the art could make numerous alterations to the disclosed embodiments without departing from the spirit or scope of the inventive subject matter set forth in the specification and claims. Joinder references (e.g. attached, adhered, joined) are to be construed broadly and may include intermediate members between a connection of elements and relative movement between elements. As such, joinder references do not necessarily infer that two elements are directly connected and in fixed relation to each other. In some instances, in methodologies directly or indirectly set forth herein, various steps and operations are described in one possible order of operation, but those skilled in the art will recognize that steps and operations may be rearranged, replaced, or eliminated without necessarily departing from the spirit and scope of the present invention. It is intended that all matter contained in the above description or shown in the accompanying drawings shall be interpreted as illustrative only and not limiting. Changes in detail or structure may be made without departing from the spirit of the invention as defined in the appended claims.

Although the present invention has been described with reference to the embodiments outlined above, various alternatives, modifications, variations, improvements and/or substantial equivalents, whether known or that are or may be presently foreseen, may become apparent to those having at least ordinary skill in the art. Listing the steps of a method in a certain order does not constitute any limitation on the order of the steps of the method. Accordingly, the embodiments of the invention set forth above are intended to be illustrative, not limiting. Persons skilled in the art will recognize that changes may be made in form and detail without departing from the spirit and scope of the invention. Therefore, the invention is intended to embrace all known or earlier developed alternatives, modifications, variations, improvements, and/or substantial equivalents.

The invention claimed is:

1. A grooved supporting member for assisting in the construction of a planar stackable member structure, said grooved supporting member comprising:

a planar base member comprising:

a top surface;

a bottom surface;

a center;

at least one edge; and at least one substantially straight, groove between the at least one edge and the center of said planar base member for receiving a planar stackable member.

2. The grooved supporting member of claim 1 wherein the length of said groove is approximately one half the length of said planar stackable member and said planar stackable member is loosely held in said at least one groove.

3. The grooved supporting member of claim 2 wherein the dimensions of planar stackable members are such that two planar stackable member lengths approximately equal three planar stackable member widths.

4. The grooved supporting member of claim 1, wherein said groove is at an angle to the normal of said planar base member.

5. The grooved supporting member of claim 4, wherein said angle to the normal of said planar base member is approximately 9.2 degrees.

6. The grooved supporting member of claim 1, wherein said groove has a width of approximately 0.0625 inches.

7. The grooved supporting member of claim 1, wherein said planar base member has a thickness from said top surface to said bottom surface between, ⅛ inch and 3/16 inch.

8. The grooved supporting member of claim 1, wherein said planar base member measures approximately 2.1719 inches by 2.1719 inches.

9. The grooved supporting member of claim 1 wherein said planar base member comprises four grooves for receiving a planar stackable member.

10. A planar base member for assisting in the construction of a card structure comprising:

a top surface;

a bottom surface;

a center;

four edges; and a rigid groove between each of said four edges and the center of said planar base member for receiving at least one building card structure member;

wherein said parallel to said four edges;

wherein said groove is approximately half the length of said building card structure member;

wherein said card structure member is loosely held by said groove; and wherein said groove is at an angle to the normal of said planar base member.

11. A kit for building a structure from planar stackable members comprising:

a planar base member for supporting at least one planar stackable member comprising:

a top surface;

a bottom surface;

a center;

at least one edge; and at least one substantially straight groove between at least one edge and the center of said planar base member, said substantially straight groove parallel to said at least one edge in said planar base member for receiving a planar stackable member; and a plurality of planar stackable members;

wherein said planar stackable members are loosely held in place in said structure by means selected from the group consisting of balance, friction, said planar base member, and combinations thereof.

12. The kit of claim 11 wherein said support member includes four grooves for receiving four planar stackable members.

13. The kit of claim 11 wherein said planar stackable member is a playing card.

14. The kit of claim 13 wherein said plurality of planar stackable members comprises at least one deck of playing cards.

15. The kit of claim 11 wherein said structure may be collapsed and said support member and said planar stackable members reused.

16. The kit of claim 11 wherein the dimensions of the planar stackable members are such that two planar stackable member lengths approximately equal three planar stackable member widths.

* * * * *